5/20/86 XR 4,589,486

United States Patent [19]

Brown et al.

[11] Patent Number: 4,589,486

[45] Date of Patent: May 20, 1986

[54] CARBON DIOXIDE FLOODING WITH A PREMIXED TRANSITION ZONE OF CARBON DIOXIDE AND CRUDE OIL COMPONENTS

[75] Inventors: Alfred Brown; Stewart Haynes; Gerald W. Alves, all of Houston, Tex.; Frank H. Lim, Aurora, Colo.

[73] Assignee: Texaco Inc., White Plains, N.Y.

[21] Appl. No.: 605,756

[22] Filed: May 1, 1984

[51] Int. Cl.[4] ..... E21B 43/16

[52] U.S. Cl. ..... 166/252; 166/273; 166/274

[58] Field of Search ..... 166/252, 273, 274

[56] References Cited

U.S. PATENT DOCUMENTS

| | | | |
|---|---|---|---|
| 2,875,830 | 3/1959 | Martin et al. | 166/7 |
| 2,875,832 | 3/1959 | Martin et al. | 166/9 |
| 3,295,601 | 1/1967 | Santourian | 166/9 |
| 3,811,503 | 5/1974 | Burnett et al. | 166/252 |
| 3,856,086 | 12/1974 | Braden, Jr. | 166/274 |
| 4,136,738 | 1/1979 | Haynes, Jr. et al. | 166/273 |
| 4,271,905 | 6/1981 | Redford et al. | 166/263 |
| 4,299,286 | 11/1981 | Alston | 166/274 |
| 4,418,753 | 12/1983 | Morel et al. | 166/273 |

OTHER PUBLICATIONS

Journal of Petroleum Technology, D. H. Stright, Jr. et al., Carbon Dioxide Injection into Bottom-Water, Undersaturated Viscous Oil Reservoirs—12/74, p. 1248.

Journal of Petroleum Technology, L. W. Holm, V. A. Josendal, Mechanisms of Oil Displacement by Carbon Dioxide—10/77, p. 1427.

SPE #11678, T. M. Doscher et al., A Controversial Laboratory Study of the Mechanism of Crude Oil Displacement by Carbon Dioxide: Part III—Nitrogen vs. Carbon Dioxide in Dipping Models—p. 131.

SPE Journal T. Ahmed et al., Preliminary Experimental Results of High-Pressure Nitrogen Injection for EOR Systems, 4/83, p. 339.

*Primary Examiner*—Stephen J. Novosad
*Assistant Examiner*—Bruce M. Kisliuk
*Attorney, Agent, or Firm*—Jack H. Park; Kenneth R. Priem; Harold J. Delhommer

[57] ABSTRACT

The disclosed invention is a method of recovering hydrocarbons by determining the critical concentrations of various crude oil components to carbon dioxide to achieve first contact miscibility of a mixture of said crude oil components and carbon dioxide with the underground hydrocarbons at formation temperature and a selected pressure substantially lower than first contact miscibility pressure of carbon dioxide with the hydrocarbons; injecting into the formation a premixed transition zone slug comprising carbon dioxide and said crude oil components at said critical concentrations, formation temperature and said selected pressure; and injecting a drive fluid into the formation after the premixed transition zone slug.

13 Claims, No Drawings

CARBON DIOXIDE FLOODING WITH A PREMIXED TRANSITION ZONE OF CARBON DIOXIDE AND CRUDE OIL COMPONENTS

BACKGROUND OF THE INVENTION

This invention relates to the recovery of underground hydrocarbons in an enhanced oil recovery flood by the use of a premixed transition zone slug composed of carbon dioxide and critical concentrations of crude oil components which give the premixed transition zone slug first contact miscibility with the underground hydrocarbons at formation temperature and a selected pressure substantially lower than the pressure needed for first contact miscibility of carbon dioxide with the underground hydrocarbons.

It has long been known that oil recovery can be improved from most reservoirs by the injection of carbon dioxide into the reservoir. The carbon dioxide generally reduces the viscosity of the hydrocarbons and swells the oil, thereby leading to increased recovery. The general goal of carbon dioxide flooding is to achieve the maximum possible miscibility of the carbon dioxide with the underground hydrocarbons within economic limitations and achieve such miscibility as early as possible in the flood. Unfortunately, injection pressures greater than or equal to 5,000 psi are required to achieve first contact miscibility of carbon dioxide with the hydrocarbons in most underground formations. The cost of achieving such high injection pressures and the inability to use such high injection pressures in many reservoirs prevents the desirable goal of first contact miscibility from being reached at an early stage in the flood. As a result, many carbon dioxide floods have been designed as multiple contact miscibility floods, wherein this miscibility is not achieved until after many contacts of the carbon dioxide with the underground hydrocarbons over a substantial radial distance from the injection well. Such floods are not as efficient as floods in which the carbon dioxide achieves first contact miscibility with the hydrocarbons.

It is also well known in the art to mix various hydrocarbon solvents with carbon dioxide to further lower the viscosity of the underground hydrocarbons and increase the flood recovery efficiency. This approach has been tried with many different mixtures of carbon dioxide and hydrocarbons in attempts to recover more oil. Most solvents used are relatively low molecular weight hydrocarbons ranging from methane to hexane. The flooding efficiencies of such processes are generally greater than flooding with only carbon dioxide, but are achieved at the increased cost of the injected hydrocarbons.

U.S. Pat. No. 2,875,832 discloses a method of injecting carbon dioxide into a formation at a pressure of 300 to 1400 psi and higher, recovering the produced fluids, condensing the produced liquids from the produced fluids and recycling the gaseous effluent into the injection well for increased recovery. Although this method substantially increases the recovery of hydrocarbons, a substantial period of time must pass before first contact miscibility is achieved in the formation and production of fluids is achieved. And years may pass before produced fluids are recovered for injection into the reservoir. The produced fluids must also be mixed together well prior to injection into the ground. Even with substantial mixing, some components of the produced fluids, particularly light ends, will be lost.

U.S. Pat. Nos. 2,875,830, 3,295,601, 3,811,503 and 4,136,738 disclose methods of flooding with mixtures of carbon dioxide and light hydrocarbons in the range of ethane to butane and methane to hexane (for 4,136,738) to achieve conditional miscibility. A cyclical push-pull process is advocated by U.S. Pat. No. 3,295,601 to condition the near wellbore area for the injection well to a miscible state so that a resulting drive fluid can be more effective. U.S. Pat. No. 4,271,905 discloses carbon dioxide combined with naphtha as a flooding medium.

Articles in the Journal of Petroleum Technology of December 1974, p. 1427 and October 1977, p. 1248 discuss the use of mixtures of carbon dioxide and light hydrocarbons for oil displacement. A similar disclosure can also be found in SPE Paper No. 11678 entitled "A Controversial Laboratory Study Of The Mechanism Of Crude Oil Displacement By Carbon Dioxide", presented at the 1983 California Regional Meeting of the Society of Petroleum Engineers of AIME in Ventura, Calif., Mar. 23–25, 1983.

In a study of the miscibility of nitrogen injection systems, entitled "Preliminary Experimental Results of High-Pressure Nitrogen Injection for EOR Systems, Society of Petroleum Engineers Journal, April 1983, p. 339, the authors analyzed the stripping mechanism of nitrogen injected through crude oil. They noted that the primary displacement mechanism was a stripping process which enriched the nitrogen with crude oil fractions of $C_1$ through $C_5$ and a small quantity of intermediate crude fractions. It was disclosed that the enrichment of nitrogen vapor continued until miscibility was reached.

SUMMARY OF THE INVENTION

The present invention is an improved carbon dioxide process for recovering hydrocarbons from an underground formation. The process is conducted by injecting into the formation a premixed transition zone slug comprising carbon dioxide and various crude oil components at specific critical concentrations, formation temperature and a selected pressure which is substantially lower than the pressure needed for first contact miscibility of carbon dioxide with the underground hydrocarbons. The premixed slug is injected in a volume sufficient to form a transition zone between the hydrocarbons of the formation and subsequently injected carbon dioxide or another drive fluid.

The critical concentrations of crude oil components to carbon dioxide for the underground hydrocarbons of interest are determined by conducting simulated floods of formation crude with carbon dioxide at formation temperature and selected pressures and analyzing the produced effluent. The premixed transition zone is comprised of carbon dioxide and crude oil components in the concentrations found in the produced effluent from the simulated floods. Such a premixed slug will achieve first contact miscibility with the underground hydrocarbons at or near the sandface and can be followed by additional carbon dioxide or another drive fluid.

To achieve a gravity stable flood, it may be necessary to taper the last part of the transition zone or add a gas or hydrocarbon to the following drive fluid to more closely match the densities of the trailing end of the transition zone slug and the following drive fluid. This would be particularly true for a flood in a dipping reservoir.

DETAILED DESCRIPTION

When an underground hydrocarbon formation is flooded with carbon dioxide, the carbon dioxide will partially dissolve into the hydrocarbons near the injection well, lowering their viscosity. Additionally, the carbon dioxide will change the composition of the hydrocarbons by removing various crude oil components to create a solvent bank which advances through the formation ahead of the main bank of crude oil, which itself advances in front of the carbon dioxide or driving fluid. The crude oil components of the solvent bank vary in their identity and concentration according to the formation crude oil, the formation temperature, the formation pressure and the injection pressure of carbon dioxide. Unless the carbon dioxide is injected at a pressure and temperature needed for first contact miscibility, multiple contacts between the carbon dioxide and hydrocarbons will be required to mobilize the solvent bank.

The present invention concept of injecting a premixed transition zone was conceived and developed because it is impractical if no impossible to achieve the advantageous first contact miscibility of carbon dioxide with underground hydrocarbons in most crude oil reservoirs. Because first contact miscibility can usually be achieved at lower injection pressures with the invention method, miscibile flooding can be conducted in a much wider range of reservoirs. In addition, the invention method works in both saturated and undersaturated reservoirs.

The initial step of our invention process is to determine the critical concentrations of crude oil components to carbon dioxide needed to achieve first contact miscibility of a mixture of said carbon dioxide and crude oil components with the underground hydrocarbons at formation temperature and a selected pressure. This is done by measuring the components of the underground hydrocarbons that would be removed by carbon dioxide flooding.

The transition zone slug containing carbon dioxide and the crude oil components at the critical concentrations is then premixed above ground and injected into the formation in a volume sufficient to form a transition zone between the crude oil and the following fluid. An injection pressure is selected which will result in first contact miscibility between the premixed transition zone and the underground hydrocarbons. For most formations a range of injection pressures will be available. It is generally preferred to choose one of the lower injection pressures which will still yield first contact miscibility between the transition zone slug and the underground hydrocarbons. It is usually less costly to operate at lower injection pressures. If the chosen injection pressure will not provide first contact miscibility, then a higher injection pressure must be selected.

A transition zone slug of about 0.06 pore volumes to about 0.5 pore volumes, preferably about 0.1 to about 0.3 pore volumes should be injected into the formation. The transition zone slug should be large enough to maintain its discrete character while passing through the formation. With very tight well spacing, a smaller sized transition zone slug may be used. Greater well spacing or reservoir conformance problems require the use of a larger sized transition zone in order to maintain a competent transition zone throughout the passage between injection and production wells.

The injection of carbon dioxide or another drive fluid such as an inert gas, water, nitrogen, combustion gases, steam or others well known in the art follows the injection of the premixed transition zone. If the fluid is carbon dioxide, it should be injected in a discrete slug sufficient in pore volume size to maintain its integrity on its journey from injection to production well and followed by another less expensive second drive fluid.

About 0.05 to about 1.5 pore volumes of carbon dioxide may be injected after the transition zone slug to drive the slug through the formation. But preferably, a carbon dioxide slug size of about 0.05 to about 0.5 pore volumes is injected after the transition slug and followed with a second cheaper drive fluid such as nitrogen or flue gas. Water may also be used as the second drive fluid. However, water will not function as well as a gaseous second drive fluid since vertical separation of the gaseous first drive fluid and the water will occur. Of course, carbon dioxide can be injected in much greater amounts without the use of a following drive fluid.

The critical compositions and concentrations for the crude oil components and carbon dioxide in the premixed transition zone are determined from an analysis of the composition of the in situ reservoir gas and liquid hydrocarbons formed during a trial slim tube flood of the formation crude with carbon dioxide at the formation temperature and selected pressures. From an analysis of the gaseous hydrocarbon stream, the components and the concentration of the underground hydrocarbons that are removed by the carbon dioxide flood can be determined.

This critical composition may be determined by either conducting computer simulated floods or experimentally flooding a modified slim tube. Computer simulated floods are possible once sufficient information has been gathered from laboratory floods. To determine the critical composition and concentrations experimentally, a tube of sufficient length to allow the formation of a first contact miscible transition zone is employed. If the tube is too short, such a transition zone will fail to form making it impossible to determine the critical compositions and concentrations needed for the invention method. It is suggested that a twenty-foot or more slim tube, ¼ inch in diameter having suitable wall thickness to safely withstand the applied pressure, be used together with a micro vapor-liquid separator affixed to the tube's exit.

The slim tube experimental tests are conducted at reservoir temperature and the selected operating pressure. The total effluent is conducted into the micro separator, operating at reservoir temperature and selected pressure, wherein it is separated into a vapor and a liquid portion at reservoir temperature and pressure. The vapor and liquid samples are withdrawn isobarically, and samples of both streams are analyzed. Since carbon dioxide and methane predominate in the gas stream produced phase by the carbon dioxide flooding of reservoirs, it has been found that the composition of the ethane plus fraction of the vapor stream existing in the reservoir (and indicated by the analysis of the vapor portion produced by the above vapor-liquid separator) as a result of the carbon dioxide flood makes an excellent transition zone slug.

A second slim tube with the same formation hydrocarbons as the first tube and held at formation temperature and the same selected pressure is also required. The second slim tube is used to test the alleged transition zone slug emerging from the first slim tube. If the alleged transition zone slug sweeps the hydrocarbons from the second tube (giving a 90% plus recovery efficiency), then it can be safely assumed that the first tube has produced a satisfactory transition zone for analysis which is first contact miscible with the underground hydrocarbons at the given conditions. If the alleged transition zone leaves substantial hydrocarbons in the second slim tube, it is not a transition zone and the experimental flood must be rerun, perhaps with a longer first slim tube.

Preferably, the premixed transition zone slug is prepared from refined hydrocarbon fractions. It is also possible for the transition zone slug to be made up by gassing carbon dioxide through crude oil produced from the formation and recovering the effluent. However, it would be very difficult to prepare a satisfactory transition zone slug in this alternate manner. Special expensive high pressure vessels would be required as well as exacting procedures. Stock tank oil would have already lost some of the necessary light ends.

The present invention provides several advantages over the prior art methods of carbon dioxide flooding. With the present invention, the miscible flood bank is formed very early and mobilizes virtually all of the oil near the injection well and sweeps it along with other oil contacted to the production well or wells. As a result, more oil is recovered. With conditional miscibility or non-miscible flooding, considerable time and radial distance from the injection well elapses before miscibility is achieved with the underground hydrocarbons.

Second, the economics of the present invention are much more favorable. Instead of having to inject large quantities of carbon dioxide to establish a miscible zone, only a small slug of 0.06 to about 0.5 pore volumes, preferably about 0.1 to about 0.3 pore volumes of a mixture of carbon dioxide and crude oil components need be injected into the formation. This transition zone may be followed directly by a drive fluid, or a second slug comprising carbon dioxide which can then be followed by a drive fluid if desired. Thus, it is possible to achieve the advantages of first contact miscible carbon dioxide flooding in reservoirs where it has not been thought possible by injecting a much smaller quantity of carbon dioxide into the formation with the present invention process.

The following examples will further illustrate the novel method of the present invention of injecting a premixed transition zone slug. These examples are given by way of illustration and not as limitations on the scope of the invention. Thus, it should be understood that the instant method may be varied to achieve similar results with the scope of the invention.

Computer simulations based upon data and correlations developed from multiple slim tube miscibility runs conducted in the laboratory were employed to generate the examples. In the computer simulations a reservoir fluid having the composition of Table I was charged to a twenty foot long, one-quarter inch diameter slim tube packed with sand. The sand pack was set up with a porosity of 0.379 and a permeability of 3000 millidarcies to roughly represent a Southern Louisiana oil field.

TABLE I

CHARACTERISTICS OF THE RESERVOIR FLUID

| Component Name | Composition Mol Fraction | |
|---|---|---|
| $N_2$ | 0.0067 | |
| $CO_2$ | 0.0035 | |
| $C_1$ | 0.4794 | |
| $C_2$–$C_3$ | 0.0481 | |
| $C_4$ | 0.0119 | |
| $C_5$–$C_6$ | 0.0249 | |
| $C_7$–$C_{11}$ | 0.1692 | |
| $C_{12}$–$C_{22}$ | 0.1816 | $C_{7+}$ molecular weight = 248 lb/mole |
| $C_{23+}$ | 0.0747 | $C_{7+}$ Gravity = 39.2° API |
| | 1.0000 | |

Carbon dioxide floods were run at 164° F. and 3250 3000, 2750 and 2500 psia. The slim tube effluent was separated at the operating temperature and the various pressures into a gaseous and liquid portion. The analyses of the gaseous portions are given in Table II both on a total and an ethane plus basis.

TABLE II

COMPOSITION OF RESERVOIR GAS PHASE AS DETERMINED IN A MICRO-SEPARATOR

| Pressure | Composition, Mol Fraction | | | | | | | |
|---|---|---|---|---|---|---|---|---|
| | 3250 | | 3000 | | 2750 | | 2500 | |
| Basis | Total | $C_{2+}$ | Total | $C_{2+}$ | Total | $C_{2+}$ | Total | $C_{2+}$ |
| Component Name | | | | | | | | |
| $N_2$ | 0.0186 | — | 0.0183 | — | 0.0180 | — | 0.0176 | — |
| $CO_2$ | 0.0046 | — | 0.0045 | — | 0.0045 | — | 0.0046 | — |
| $C_1$ | 0.9256 | — | 0.9278 | — | 0.9294 | — | 0.9304 | — |
| $C_2$–$C_3$ | 0.0365 | 0.713 | 0.0365 | 0.739 | 0.0367 | 0.761 | 0.0371 | 0.783 |
| $C_4$ | 0.0039 | 0.076 | 0.0038 | 0.077 | 0.0037 | 0.077 | 0.0036 | 0.076 |
| $C_5$–$C_6$ | 0.0040 | 0.078 | 0.0037 | 0.075 | 0.0034 | 0.071 | 0.0032 | 0.067 |
| $C_7$–$C_{11}$ | 0.0060 | 0.117 | 0.0049 | 0.090 | 0.0040 | 0.083 | 0.0033 | 0.070 |
| $C_{12}$–$C_{22}$ | 0.0008 | 0.016 | 0.0005 | 0.010 | 0.0004 | 0.008 | 0.0002 | 0.004 |
| $C_{23+}$ | — | — | — | — | — | — | — | — |
| Total | 1.0000 | 1.000 | 1.0000 | 1.000 | 1.0000 | 1.000 | 1.0000 | 1.000 |

Four additional slim-tube simulations were then performed using the same reservoir fluid as that described in Table I. A thirteen percent pore volume premixed transition zone slug was injected into the tube and followed with pure carbon dioxide. The composition of the transition zone slug used in these latter experiments consisted of the ethane plus fraction of the gas phase as given in Table II above.

Recoveries of the reservoir oil observed as a result of these solvent runs are given in Table III where recoveries are corrected for the amount of solvent injected. Table III aptly demonstrates the high miscible recoveries achieved with the invention method at injection pressures substantially lower than the miscibility pressure required for carbon dioxide flooding. The 90% recovery of the pure carbon dioxide flood at 3250 psia was achieved with the invention method at pressures as low as 2500 psia.

The interfacial tension calculations evidence that first contact miscibility or very similar flooding conditions were achieved between the underground hydrocarbons and the premixed transition zone slug at 3000, 2750 and 2500 psia. It is generally believed that interfacial tensions less than or equal to 0.001 dynes/cm manifest first contact miscibility conditions.

TABLE III

RECOVERIES AT GAS BREAKTHROUGH AS DETERMINED BY SLIM-TUBE SIMULATION

| Pressure, psia | 3250 | 3000 | 2750 | 2500 |
|---|---|---|---|---|
| Recovery, pore volumes | | | | |
| Pure $CO_2$ | 0.90 | 0.62 | 0.58 | 0.58 |
| Transition zone slug (0.13 $V_p$) followed by pure $CO_2$ | — | 0.90 | 0.90 | 0.91 |
| Interfacial tension, dyne/cm* | | | | |
| Pure $CO_2$ | 0.11 | 0.88 | 1.5 | 2.4 |
| Transition zone slug (0.13 $V_p$) followed by pure $CO_2$ | — | <0.001 | <0.001 | <0.001 |

*NOTE:
Periodically, samples of the reservoir gas and liquid phases were obtained and analyzed. The interfacial tension was then calculated using the MacLeod-Sugden (R-1) procedure. These values are reported in Table III together with the interfacial tensions calculated for those runs in which only pure $CO_2$ was used as a flooding agent. It is well known that, whenever gas-liquid phase interfacial tensions are below about 0.1 dynes/cm, very efficient displacements approaching those of first-contact miscibility are possible.

Simulated floods were also performed with transition zone slugs of various sizes. In one set of floods, a transition zone slug sized at 0.0625 pore volumes and having the same composition as the transition zone slug of Table II at 2500 psia was injected into a reservoir having the characteristics of Table I.

A 0.0625 pore volume transition zone slug was injected followed by only 0.19 pore volumes of carbon dioxide. This achieved an interfacial tension ratio ($\sigma/\sigma_o$) of less than 0.001 (which indicates complete miscibility) at the flood front about one-fifth of the fractional distance between the injection and production points. When the 0.0625 pore volume transition zone slug was followed by about 0.44 pore volumes of carbon dioxide an interfacial tension ratio of less than 0.01 was obtained at the flood front halfway through the flood path.

The same sized transition zone slug recovered over 91% of the reservoir oil when followed by 0.87 pore volumes of carbon dioxide. Of course, other well known driving fluids such as water, nitrogen or flue gas may substituted for some of the following carbon dioxide with much the same results. But it is preferred to use a following carbon dioxide slug of about 0.05 to about 0.5 pore volumes before changing to a different driving fluid.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A process for recovering hydrocarbons from an underground formation, comprising the steps of:

(a) determining the critical concentrations of crude oil components to carbon dioxide to achieve first contact miscibility of a mixture of said crude oil components and said carbon dioxide with the underground hydrocarbons at formation temperature and a selected pressure substantially lower than the pressure needed for first contact miscibility of carbon dioxide with said hydrocarbons;

(b) injecting into the formation a premixed transition zone slug comprising carbon dioxide and said crude oil components at said critical concentrations, formation temperature and said selected pressure, said premixed slug injected in a volume sufficient to form a transition zone between the underground hydrocarbons and a drive fluid injected after the premixed transition zone slug; and (c) injecting a drive fluid into the formation.

2. The process of claim 1, wherein about 0.06 to about 0.5 pore volumes of said premixed slug is injected.

3. The process of claim 1, wherein the drive fluid is carbon dioxide.

4. The process of claim 3, wherein a slug of about 0.05 to about 1.5 pore volumes of carbon dioxide drive fluid is injected into the formation after the injection of said premixed slug.

5. The process of claim 4, wherein a second drive fluid is injected into the formation after injection of the carbon dioxide slug.

6. The process of claim 5 wherein the second drive fluid is nitrogen.

7. The process of claim 1, wherein said critical concentrations are determined by conducting simulated floods by flooding formation crude with carbon dioxide at formation temperature and said selected pressure and analyzing the produced effluent.

8. The process of claim 1, wherein the premixed slug is prepared by gassing carbon dioxide through crude oil from said formations.

9. The process of claim 1, wherein the premixed slug is prepared from refined hydrocarbon fractions and carbon dioxide.

10. A process for recovering hydrocarbons from an underground formation, comprising the steps of:

(a) determining the critical concentrations of crude oil components to carbon dioxide to achieve first contact miscibility of a mixture of said carbon dioxide and crude oil components with the underground hydrocarbons at formation temperature and a selected pressure substantially lower than the pressure needed for first contact miscibility of carbon dioxide with said hydrocarbons, (b) said critical concentrations determined by conducting laboratory floods wherein carbon dioxide is injected into formation crude at formation temperature and said selected pressure and analyzing the produced effluent;

(c) injecting into the formation about 0.06 to about 0.3 pore volumes of a premixed transition zone slug comprising carbon dioxide and said crude oil components at said critical concentrations, formation temperature and said selected pressure to form a transition zone between the underground hydrocarbons and a drive fluid injected after the premixed transition zone slug;

(d) injecting about 0.05 to about 0.5 pore volumes of carbon dioxide as a drive fluid into the formation; and (e) injecting a second drive fluid after the injection of carbon dioxide.

11. The process of claim 10, wherein the second drive fluid is nitrogen.

12. The process of claim 10, wherein the second drive fluid is water.

13. A process for recovering hydrocarbons from an underground formation, comprising the steps of:

(a) determining the critical concentrations of five or more fractions from $C_1$ to $C_{10}$ of crude oil components to carbon dioxide to achieve first contact miscibility of a mixture of said carbon dioxide and crude oil components with the underground hydrocarbons at formation temperature and a selected pressure substantially lower than the pressure needed for first contact miscibility of carbon dioxide with said hydrocarbons, (b) said critical concentrations determined by conducting laboratory floods wherein carbon dioxide is injected into formation crude at formation temperature and said selected pressure and analyzing the produced effluent;

(c) injecting into the formation about 0.06 to about 0.3 pore volumes of a premixed transition zone slug comprising carbon dioxide and said five or more fractions of crude oil components at said critical concentrations which occur in the produced effluent, formation temperature and said selected pressure to form a transition zone between the underground hydrocarbons and a drive fluid injected after the premixed transition zone slug; and (d) injecting a drive fluid into the formation.

* * * * *